United States Patent [19]

Fritz et al.

[11] Patent Number: 4,483,316

[45] Date of Patent: Nov. 20, 1984

[54] AIR VENTILATION SYSTEM

[75] Inventors: Frederick F. Fritz, Oxford; Ralph L. Daigle, Ortonville, both of Mich.

[73] Assignee: Alco Foodservice Equipment Company, Miami, Fla.

[21] Appl. No.: 540,370

[22] Filed: Oct. 11, 1983

[51] Int. Cl.[3] ..... F24C 15/06; F23J 11/00

[52] U.S. Cl. ..... 126/299 D; 126/299 R; 98/36; 98/33 A; 55/DIG. 36

[58] Field of Search ..... 126/299 D, 299 E, 299 F, 126/299 R, 312; 98/41 R, 36, 33 A; 55/DIG. 36

[56] References Cited

U.S. PATENT DOCUMENTS

| | | | |
|---|---|---|---|
| 2,868,108 | 1/1959 | Petersen | 126/299 D |
| 2,888,871 | 6/1959 | Fischer et al. | 126/299 D |
| 3,530,784 | 9/1970 | Courchesne | 126/299 D |
| 3,837,269 | 9/1974 | Sweet | 126/299 D |
| 4,129,121 | 12/1978 | Dorius | 126/299 D |
| 4,134,394 | 1/1979 | Otenbaker | 126/299 D |
| 4,153,044 | 5/1979 | Nett | 126/299 D |
| 4,346,692 | 8/1982 | McCauley | 126/299 D |
| 4,373,509 | 2/1983 | Neitzel et al. | 126/299 D |

*Primary Examiner*—James C. Yeung

*Attorney, Agent, or Firm*—Robert G. Mentag

[57] ABSTRACT

An air ventilation system for cooking equipment having an exhaust hood disposed thereover in a building having a heating-ventilating and air-conditioning system for treating the air in the building. The exhaust hood includes a collection chamber and an exhaust chamber with a filter means mounted therebetween. An exhaust fan draws air loaded with cooking vapors, odors, fumes, smoke and other pollutants collected in the collection chamber through the filter and the exhaust chamber and out through an exhaust passage to the atmosphere. A source of fresh air provides a predetermined amount of fresh makeup air to the collection chamber. A temperature control unit is connected to another source of fresh air, and to the return air duct of the heating-ventilating and air-conditioning system of the building or a room in the building, for providing a combination of fresh air and tempered air to an air curtain passage for forming an air curtain along the front side of the exhaust hood.

14 Claims, 5 Drawing Figures

AIR VENTILATION SYSTEM

TECHNICAL FIELD

This invention relates generally to the air ventilation art, and more particularly, to an improved air ventilation system for exhausting the exhaust air, from restaurant cooking equipment through an exhaust hood. The air ventilation system of the present invention is adapted to introduce a majority of the required make-up air under the exhaust hood, and to provide a temperature controlled air curtain in front of the exhaust hood to provide the balance of the required make-up air, and also to provide for the comfort of the chef preparing food with the cooking equipment ventilated by the air ventilation system.

BACKGROUND ART

It is known in the air ventilating art for exhaust systems for cooking equipment to provide exhaust hoods. Heretofore, air curtains have been provided above the cooking equipment in a restaurant. U.S. Pat. No. 4,134,394 discloses an air ventilation system for a restaurant cooking equipment exhaust hood, and which employs tempered air drawn from the dining room of a restaurant. A disadvantage of the air ventilating system disclosed in U.S. Pat. No. 4,134,394 is that it removes air-conditioned air from the restaurant building during the cooling season, and an uncontrolled amount of heated air from the restaurant building during the heating season, and the chef cannot control the temperature of the air curtain. U.S. Pat. No. 3,800,689 also discloses a building ventilating system disposed over a cooking unit, and it provides an air curtain above the cooking unit that comprises a mixture of filtered exhaust air and fresh air. A disadvantage of the air ventilation system disclosed in U.S. Pat. No. 3,800,689 is that the air curtain includes exhausted air which may include some pollutants not filtered by the exhaust hood filtering system. U.S. Pat. No. 3,837,269 discloses an apparatus for ventilating kitchen exhaust fumes and treating the exhaust fumes to remove air pollutants, and then exhausting the fumes to the atmosphere, or partially recirculating some of it through the kitchen cooking area. The last described air ventilating system does not provide any air curtain for the comfort of the chef working with the cooking equipment which is ventilated by the air system of the last mentioned patent.

U.S. Pat. No. 3,978,777 discloses a ventilating apparatus for restaurant cooking equipment in which part of the make-up air entering the exhaust hood of the ventilating apparatus is untempered air, and a portion of the air entering the exhaust hood is tempered air drawn from the surrounding room. A disadvantage of the ventilating apparatus shown in the last mentioned patent is that there is no control over the supply source of the tempered air which is under the exhaust hood and it is all drawn from the kitchen area surrounding the cooking equipment. U.S. Pat. No. 3,457,850 discloses an air ventilation system for cooking equipment which uses untempered or fresh air for the make-up air to replace the exhaust gases. It also employs the use of an outlet register in the make-up air supply system to permit some of the untempered air to be blown into the kitchen in a position over the head of the chef operating cooking equipment but not directly downward. The flow of untempered air is directed outwardly into the surrounding room area. The temperature of the untempered air entering the room in accordance with the last described air ventilation system would depend on the outside air temperature, and an outside air blower is provided with a cooler which could be used on warm days to provide cool make-up air.

U.S. Pat. No. 3,890,887 discloses an air ventilation system for restaurant cooking equipment which employs temperature controlled fresh air for make-up air, and for directing a portion of the same into the kitchen area around the cooking equipment. A disadvantage of the air ventilation systems shown in the last two mentioned patents is that they require a separate cooling means in their fresh air supply circuit, which increases the energy requirements for operating the air ventilation system.

U.S. Pat. No. 3,411,428 discloses a ventilating hood for cooking equipment in which the make-up air is supplied from the exterior of the building, and wherein the make-up air may be supplied by outside air which can be heated before it is conveyed under the exhaust hood. The air ventilating system disclosed in the last mentioned patent does not provide any controllable air curtain for the chef operating the cooking equipment. U.S. Pat. No. 3,980,072 discloses a cooking equipment ventilating system which employs all untempered or outside air for make-up and air curtain purposes.

U.S. Pat. No. 3,664,255 discloses an air ventilation system, for restaurant cooking equipment, in which all of the make-up air is supplied from the exterior of the room in which the cooking equipment is located. A disadvantage of the air ventilating structure disclosed in the last mentioned patent is the fact that it does not provide any comfort air curtain for the chef operating the cooking equipment.

DISCLOSURE OF THE INVENTION

In accordance with the present invention, an air ventilation system is provided for exhausting air from a restaurant cooking grill of particulates and other pollutants, and which is adapted to convey the exhaust air to the atmosphere and to provide a majority of untempered make-up air from the atmosphere. The balance of the make-up air is supplied by an air curtain which selectively comprises either untempered air, tempered air, or a combination of the same, and which functions to not only cool the chef operating the cooking equipment but also to keep contaminants under the cooking equipment exhaust hood. The air for the air curtain is either drawn from the outside of the building in which the cooking equipment is located, or it is selectively drawn from the return duct of the heating and ventilating equipment of the building, or from the dining room of the restaurant in which the cooking equipment is being used. A blending chamber or temperature control unit is provided for mixing fresh or untempered air with tempered air, to the desired temperature. The air ventilation system of the present invention saves energy since it may be used so as not to remove any air-conditioned air from a restaurant building during the cooling season, and a minimum of heated air from a restaurant building during the heating season. The chef operating the cooking equipment provided with the air ventilating system of the present invention can control the temperature of the air curtain which is directed downwardly over the chef's position, by mixing untempered outside air with tempered building air, as desired. An advantage of employing tempered air from the heating and ventilating return air duct system is that all portions of the restaurant building are uniformly ventilated rather than just the dining room when tempered air is removed only from the dining room.

BEST MODE OF CARRYING OUT THE INVENTION

Figure 1:
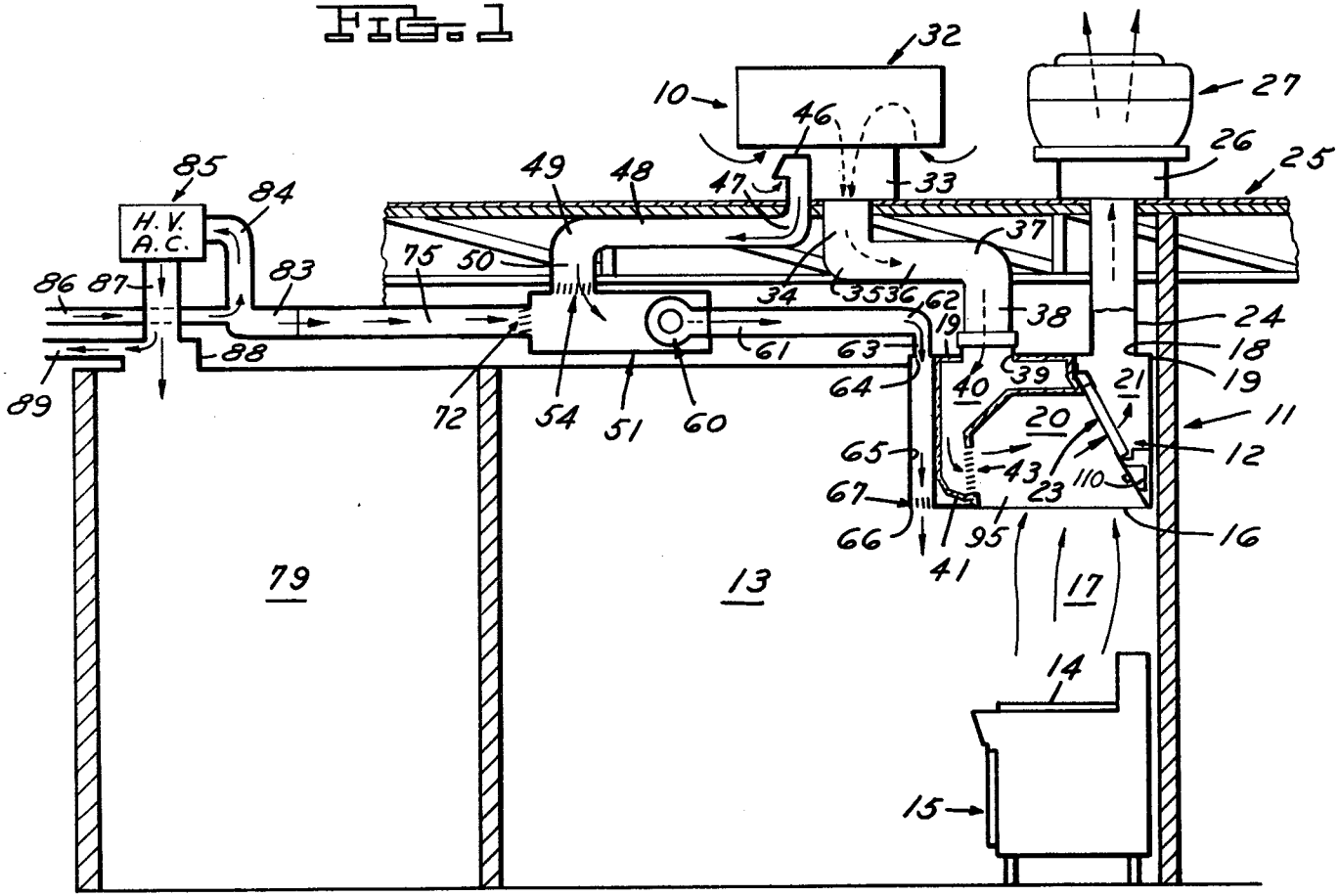
FIG. 1 is a schematic representation of a portion of a building having kitchen, dining room, and other areas which employ an air ventilation system constructed in accordance with the principles of the present invention.
Figure 2:
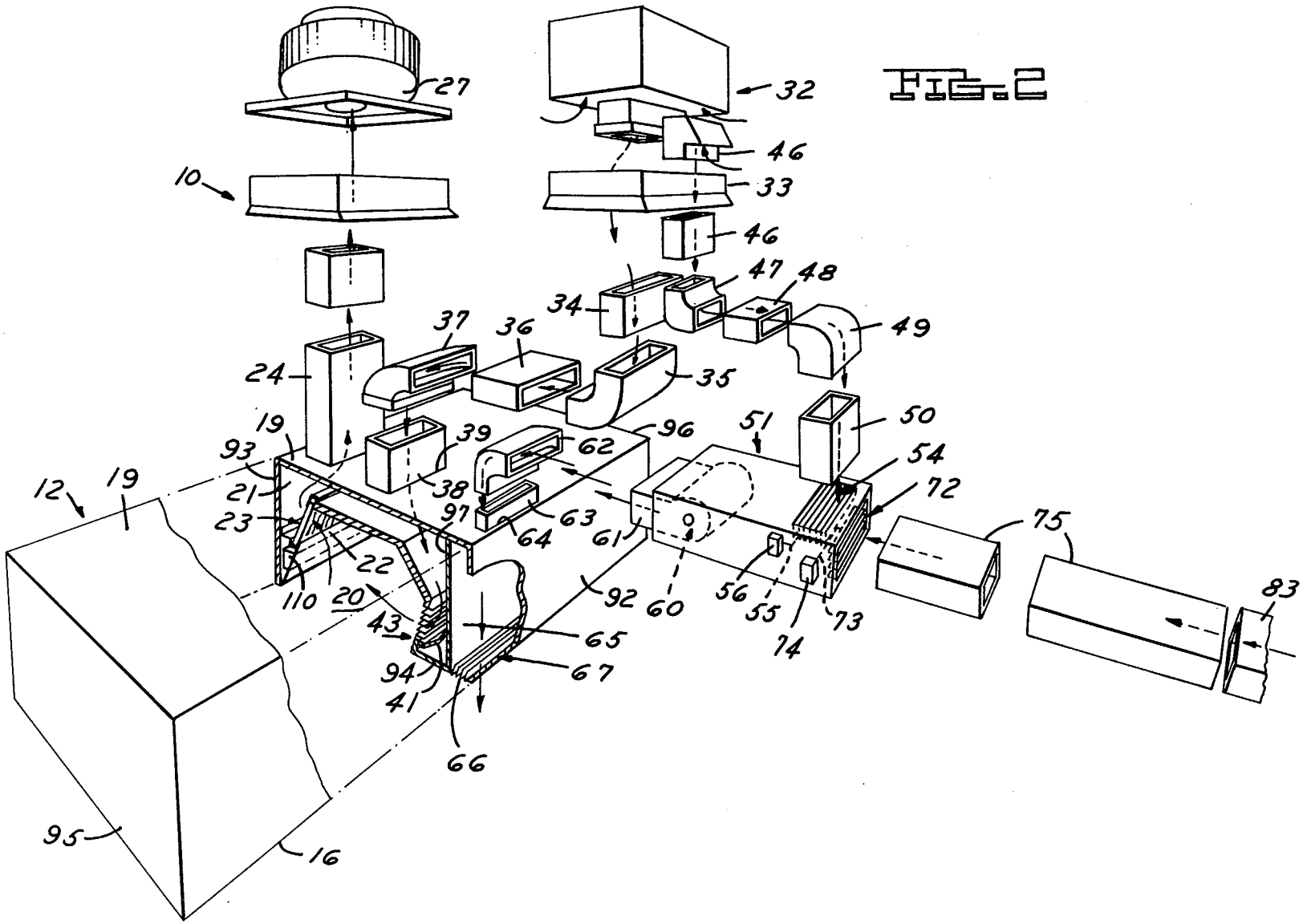
FIG. 2 is an exploded, elevation perspective view of the air ventilation system illustrated in FIG. 1.

Referring now to the drawings, and in particular to FIGS. 1 and 2, the numeral 10 generally designates an air ventilation system illustrating the principles of the present invention. The system 10 is disposed in a building, which is shown in fragment, and which is generally indicated by the numeral 11. The air ventilation system 10 comprises an exhaust compensating hood, generally indicated by the numeral 12. The hood 12 is shown as being mounted in a kitchen 13, in a position above the cooking surface 14 of a restaurant cooking stove or equipment, generally indicated by the numeral 15. As shown in FIG. 1, the working area between the lower end 16 of the exhaust hood 12 and the cooking surface 14 comprises the working air space which is indicated by the numeral 17.

Figure 3:
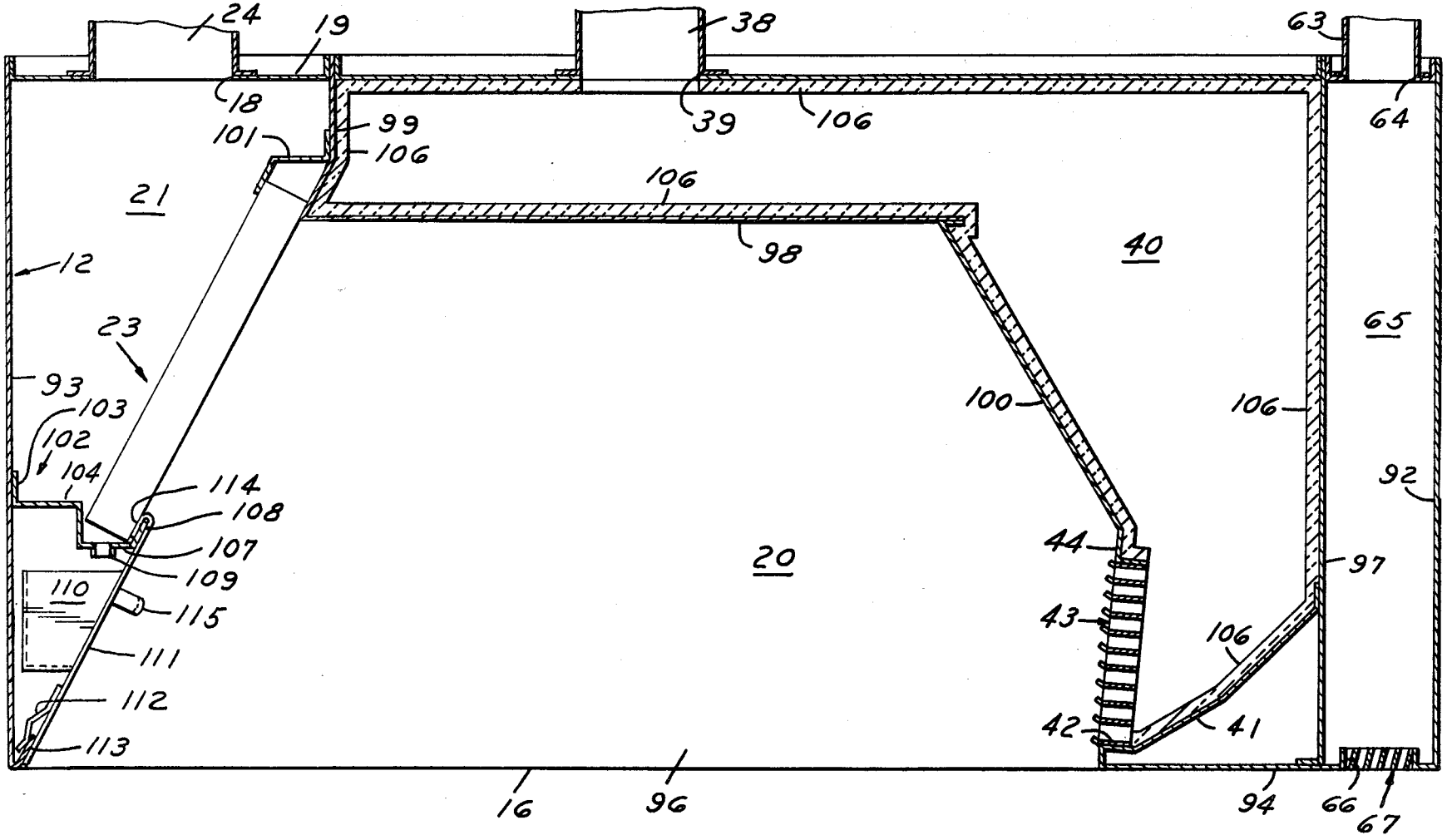
FIG. 3 is an enlarged cross-section view of the exhaust hood employed in the invention.

As shown in FIGS. 1, 2, and 3, the exhaust compensating hood 12 is provided with an internal collection chamber 20, which is open on the lower end thereof and which functions to entrap exhaust fumes, particles and heated air arising from the area of the cooking stove 15. The exhaust fumes collected in the collection chamber 20 pass through a rectangular opening 22, and into an exhaust chamber 21. The opening 22 has removably positioned therein, a suitable, conventional Underwriters Laboratories approved grease filter, generally indicated by the numeral 23. The exhaust fumes are drawn up through an opening 18 in the exhaust hood upper wall 19 and into a suitable exhaust duct 24, which has its lower end operatively connected to the upper end of the exhaust chamber 21, and its upper end extended upwardly through the roof 25 of the building 11. The upper end of the exhaust duct 24 is operatively connected through a rectangular roof curb 26, to a suitable exhaust fan, generally indicated by the numeral 27, which is operatively mounted to the roof curb 26, for exhausting the exhaust fumes to the atmosphere.

Approximately up to 80% of the volume of the air exhausted through the exhaust hood 12 and through the last described exhaust conduit or passage means is replaced by untempered, outside fresh air, by means of the following described structure. As shown in FIGS. 1 and 2, a fresh air supply fan, generally indicated by the numeral 32, is operatively mounted upon the building roof 25, by a suitable roof curb 33. A fresh air supply vertical conduit 34 is connected through the roof curb 33 to the output portion of the output or supply end of the supply fan 32. The fresh air supply duct 34 is connected by the duct elbows 35 and 37, and the straight horizontal and vertical duct portions 36 and 38, respectively, to an opening 39 in the top end wall 19 of the exhaust hood 12. The opening 39 in the exhaust hood top end wall 19 communicates with an L-shaped fresh air intake chamber 40, which has a horizontal portion disposed above the collection chamber 20, and a vertical portion disposed along the rear end of the exhaust hood 12. The vertical portion of the intake chamber 40 extends downwardly to a lower enclosed baffle end wall 41, which has a plurality of inwardly facing bends formed therein. The fresh air drawn into the intake chamber 40, flows vertically downward and is then deflected inwardly, or to the left as shown in FIG. 3, through a substantially 90 degree curved turn, by the baffle wall 41, and through an opening 42, in an angularly disposed wall 44, between the lower ends of the collection chamber 20 and the intake chamber 40. The baffle wall 41 is disposed approximately 10 degrees from the vertical axis and slopes downwardly and inwardly toward the collection chamber 20. A suitable set of angular louvers, generally indicated by the numeral 43, are operatively mounted in the opening 42, for diffusing the untempered air passing through the opening 42, and for directing said air across the collection chamber 20, and through the filter 23, as viewed in FIGS. 1 through 3. The louvers are angled upwardly at their inner ends about 15 degrees.

It will be understood that the exhaust fan 27 and the fresh air supply fan 32, may be of any suitable type and capacity, in accordance with the desired capacity of fluid flow. For example, if the exhaust fan 27 exhausts 275 cubic feet of air per minute, per lineal foot of the hood, then the supply fan 32 must be of a size to provide at least 80% of the replacement air or make-up air. The fresh air supply fan 32 may also be provided with a suitable filter means, but it does not heat or cool the fresh air that it supplies.

Untempered, outside fresh air is also introduced by the air ventilation system of the present invention, to form an air curtain along the front side of the compensating hood 12. The air curtain provides a flow of air which creates a barrier that confines smoke, grease-laden air, and odors to the cooking area, whereby, less air is required to be exhausted from the restaurant building. Because the air curtain is situated along the front of the compensating hood 12, and because the hood 12 requires less air to remove contaminates, the air ventilation system of the present invention provides an air ventilation system, which makes it economical to air-condition the kitchen 13. The air curtain is supplied by the following described structure.

A vertical fresh air supply duct 46, is connected by an elbow 47, a horizontal fresh air supply duct 48, an elbow duct 49, and a vertical fresh air supply duct 50 to an inlet opening on the top side of a temperature control unit, generally indicated by the numeral 51. The flow of untempered fresh air from the vertical duct 50 into the temperature control unit 51 is controlled by a manually operated flow control damper, generally indicated by the numeral 54 in FIG. 2. The damper 52 includes a manual control arm 55, and a manual operator 56.

The blending chamber or temperature control unit 51 has operatively mounted therein a temperature control fan, generally indicated by the numeral 60. The output end of the temperature control fan 60 is disposed on the inner end of the compensating hood 51, and it communicates with the outer end of a horizontal duct 61. The inner end of the duct 61 communicates with an elbow 62 which in turn communicates with a vertical duct 63. The lower end of the vertical duct 63 is operatively connected to an opening 64, which is formed in the upper end of a vertical passage 65 that is formed along the front side of the exhaust hood 12. The lower end of the vertical passage 65 is open, as indicated by the numeral 66, and it has operatively mounted therein a longitudinally disposed, lineal aluminum air flow diffuser, generally indicated by the numeral 67. The diffuser 67 is removably mounted in place, so that it may be quickly and easily removed for cleaning and repair purposes. The diffuser 67 is provided with a plurality of deflection blades which are disposed at an inwardly directed angle of about 15 degrees from the vertical axis of the vertical passage 65.

The last described flow passage, from the fresh air supply inlet 46 to the open end or outlet of the curtain flow passage 65, discloses the flow path of the untempered or fresh outside air for the air curtain. The next described structure discloses the inter-communication of the temperature control unit 51 with the return circuit of the heating-ventilating and air-conditioning system of the building in which the present invention is employed.

As shown in FIGS. 1 and 2, the outer end of the temperature control unit 51 is provided with an opening in which is operatively mounted a manually operated flow control damper, generally indicated by the numeral 72, which is identical to the flow control damper 54, and which is adapted to control the flow of return air through a conduit 75, to the outer end of the temperature control unit 51. The damper 72 is provided with a manual control arm 73 and a manual control operator 74, in the same manner as provided for the damper 54. The horizontal duct 75 communicates at its outer end with a return air duct 83 (FIG. 1) which in turn communicates with a return air duct 84. The air ducts 83 and 84 also communicate with a return air duct 86. The return air duct 84 is schematically illustrated in FIG. 1 as being connected to a heating-ventilating and air-conditioning apparatus, generally indicated by the numeral 85. The heating-ventilating and air-conditioning apparatus 85 is schematically illustrated as having a supply duct 87 for conducting tempered air through a register or grill 88 into the dining room 79. The supply duct 87 is also shown as being connected to a supply duct 89 for supplying tempered air to the remainder of the building.

As shown in FIGS. 1, 2 and 3, the exhaust hood 12 is schematically shown as including a top wall 19, a front wall 92, a rear wall 93, and end walls 95 and 96. A partial bottom wall 94 is formed along the front side of the hood 12. As shown in FIGS. 2 and 3, the curtain vertical passage 65 is formed between the outer front wall 92 and a vertical, inwardly spaced apart wall 97.

As shown in FIG. 3, a horizontal inner wall 98 is disposed in a position spaced downwardly from the exhaust hood top end wall 19 to form the horizontal portion of the intake chamber 40. The rear end of said horizontal intake chamber portion is bounded by a vertical wall 99. The horizontal wall 98 terminates at its front end with a downwardly and outwardly sloping wall 100, which coacts with the vertical inner wall 97 to form the downwardly directed portion of the intake chamber 40. The lower end of the sloping wall 100 terminates at the upper end of the angled inner wall 44. A suitable layer of insulation 106 is operatively mounted on the inside of the hood walls forming the intake chamber 40.

The louver means 43 is disposed with the inner ends of its blades sloping upwardly at an angle of approximately 15 degrees from the horizontal, so as to direct the flow of air through the collection chamber 20 rearwardly in an upwardly angled flow, so as to engage the grease filter 23 at an approximate perpendicular angle.

The grease filter 23 is disposed at an angle of about 60 degrees from the vertical, and it is removably held in place at its upper end by a bracket 101 which is fixedly secured to the outer face of the inner wall 99. The lower end of the wall 99 is angularly disposed, at the same angle as the filter 23, for supporting the upper end of the filter 23 between the bracket 101 and the lower end of the wall 99. The lower end of the filter 23 is removably mounted on an elongated bracket, generally indicated by the numeral 102, which is fixedly mounted on the inside of the rear wall 93.

Figure 4:
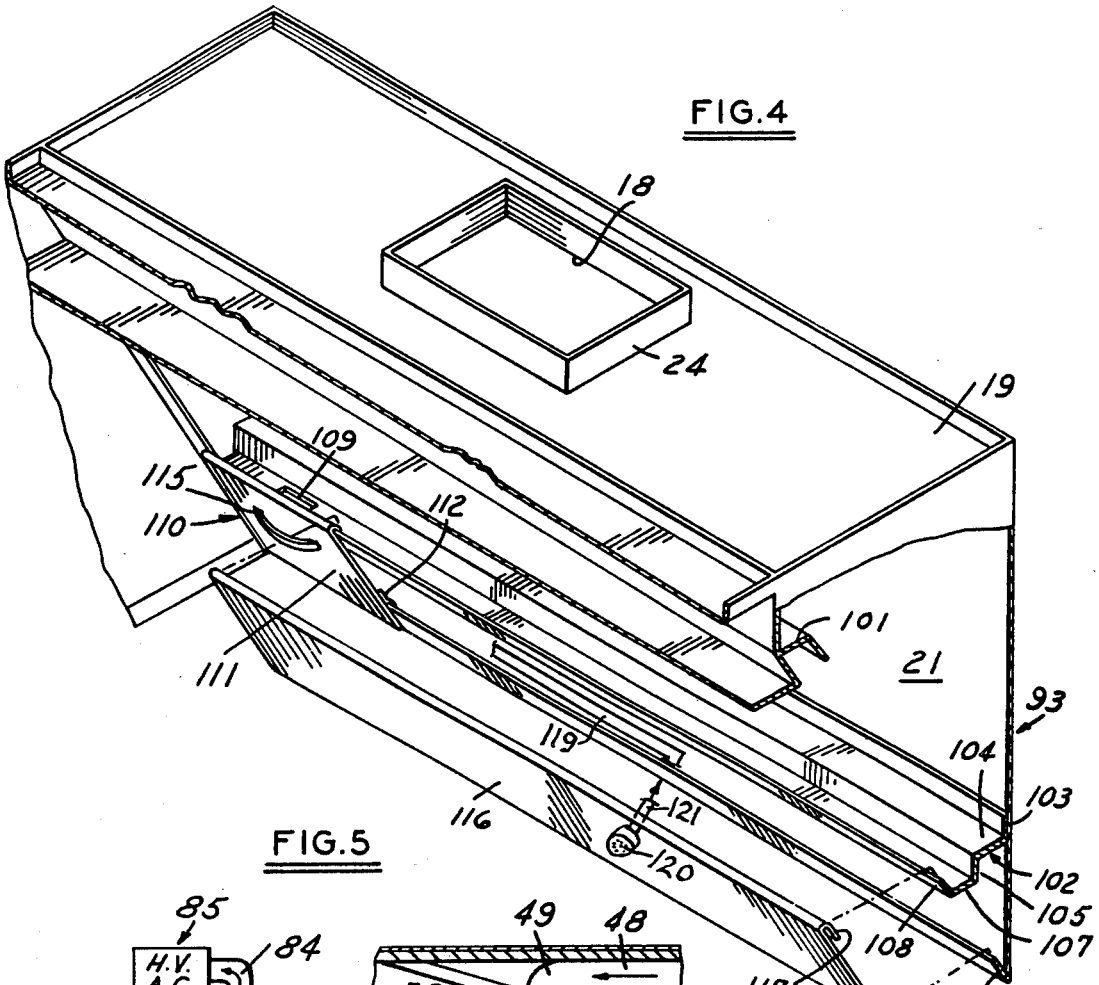
FIG. 4 is an elevation perspective view, with parts broken away, of the grease filter and supporting structure.

As shown in FIGS. 3 and 4, the filter support bracket 102 includes a vertical portion 103 which is fixed to the inside of the exhaust hood rear wall 93. The support bracket 102 includes an integral horizontal portion 104 which is integrally connected at its rear end to the vertical portion 103, and at its front end to a vertical leg portion 105. The bottom end of the bracket leg portion 105 is integrally connected to a second horizontal portion 107, which is integrally connected at its front end with an upwardly angled lip member 108. It would be seen from FIG. 3 that the filter 23 has its lower end resting on the lip 103 and the bottom portion 107. The bracket portions 105, 107 and 108 function to support the lower end of the filter 23 and to act as a grease gutter. As shown in FIGS. 3 and 4, an opening 109 is formed through the elongated grease gutter portion 107 for the drainage of grease which flows downwardly from the filter 23 into the grease gutter. The grease is drained through the opening 109 and downwardly into a removable grease cup or receptacle, generally indicated by the numeral 110. The grease receptacle 110 is box-shaped and is open at the top thereof. As shown in FIGS. 3 and 4, the outer side of the grease receptacle 110 is indicated by the numeral 111, and it angles upwardly and is provided at the lower end with a retainer clip 112, and at its upper end with a retainer clip 114. The grease receptacle 110 is removably mounted and it can be removed from the position shown in FIGS. 3 and 4 by grasping the receptacle handle 115, and moving the upper clip 114 off of the grease gutter retainer lip 108, and the lower clip 112 off of the wall lip 113, and then moving the grease receptacle 110 outwardly from the position shown in FIG. 3 for pouring the grease from the receptacle 110 into a suitable disposal container.

As shown in FIG. 4, the space below the filter support bracket 102 is an open space in which can be mounted plumbing for a suitable fire extinguishing system having a supply pipe, as schematically shown by the numeral 119 and a removable spray head and pipe 120 and 121, respectively. The last described space is enclosed by a removable front cover plate 116, through which the removable spray pipe 121 is mounted for detachable connection to the pipe 119. The removable plate 116 is provided with an upper and lower clip 117 and 118, which may be slidably mounted over the grease gutter lip 108, and the lower lip 113 on the lower end of the exhaust hood rear wall 93. The removable plate 116 is removed from its assembled position by merely sliding said plate upwardly, and then bringing it outwardly to a clearance position. The space under the grease gutter is thus free of grease, and can be used for fire extinguishing plumbing and other accessories, which are readily accessible because of the removable plate 116.

Figure 5:
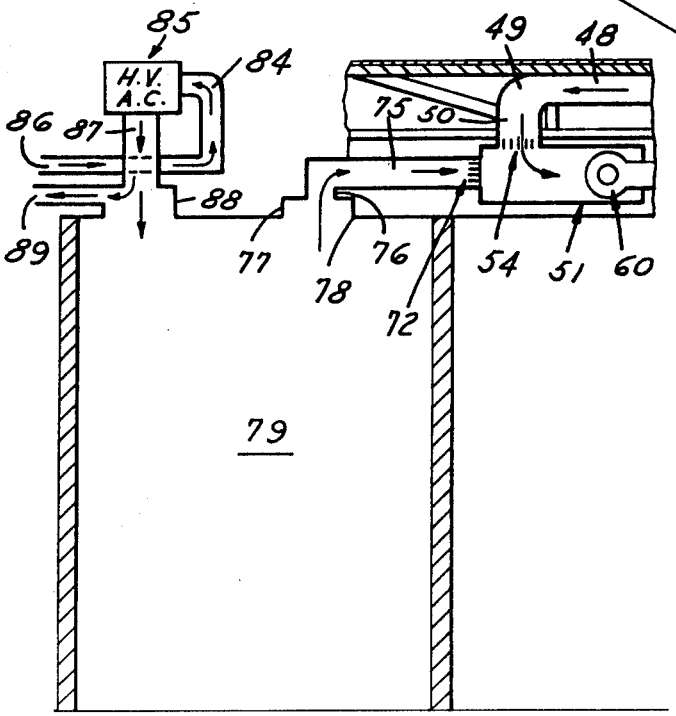
FIG. 5 is a fragmentary view of a modified tempered air supply for the air curtain.

FIG. 5 shows a modification of the invention in which the air curtain can be supplied with tempered air from the kitchen 79, by drawing tempered air through the opening 78 in the building ceiling and through the register or grill 77, and the passages 76 and 75, and thence through the flow control damper 72 and into the temperature control unit 51.

It will be understood that any suitable control system may be provided for stopping and starting the exhaust blower 27, the fresh air supply fan 32 and the temperature control unit fan 60. Any suitable manual control apparatus may be provided for selectively operating the flow control dampers 54 and 72, so as to determine the amount of fresh air and tempered air, to be combined or not combined, in the temperature control unit 51 for forming the air curtain. A suitable multi-position fresh air damper controller which may be used for controlling the operating positions of the flow control dampers 54 and 72, is one available on the market from the Trolex Corporation of 740 Federal Avenue, Kenilworth, N.J. 07033, under Model No. MPFAD-2.

In use, the volume of polluted air and gases exhausted by the exhaust fan 27 is 80% replaced by fresh outside air supplied by operation of the fresh air supply fan 32 forcing fresh air into the fresh air passageway comprising the ducts 34 through 38, and the intake chamber 40. Accordingly, if the exhaust fan 27 were exhausting 4,000 C.F.M., about 3,200 C.F.M. of make-up air will be provided in an unheated and uncooled condition to the hood 12, and again be pulled out without taking 3,200 C.F.M. from the building. The remaining 20% makeup air can either be provided by forming the air curtain with 100% fresh outside air, or a combination of fresh outside air and tempered air, with the tempered air being taken either from the dining room or the heating-ventilating and air-conditioning return air system, as selectively desired. Accordingly, in the summertime it would be possible to supply the other 800 C.F.M. for the air curtain, by using 100% outside fresh air and not taking any air-conditioned air out of the building. In the wintertime, the air curtain may also comprise 100% outside air.

The chef operating the cooking equipment 15 can control the temperature of the air curtain by manually turning the controls 56 and 74 to regulate the combinations of outside fresh air and air drawn from the building, to provide a desired temperature. In view of the foregoing, it will be seen that the air ventilation system of the present invention saves energy since it can be operated without tempered air in either the summertime or winter, depending upon the temperature of the outside air and the temperature at which the chef feels comfortable working in front of the cooking equipment 15. The removable filter 23 and the removable diffusers 43 and 67 are also advantageous, in that these elements can be quickly and easily removed for replacement or repair purposes.

The flow of makeup air through the intake chamber 40 is controlled to provide a low velocity of flow of air through the collection chamber 20, so as to engage the filter 23 at a low velocity so that the air will not bounce backwards, which is a disadvantage of prior art devices having a high velocity flow of air through the collection chamber 20. The low velocity flow is created by the fact that the makeup air enters through the duct 38 in the horizontal portion of the intake chamber 40, and then passes to the right, as viewed in FIG. 3, and is then allowed to expand into the vertical larger portion, where it is slowed down before it passes to the rear through the diffuser 43 and into the collection chamber 20.

INDUSTRIAL APPLICABILITY

The air ventilation system of the present invention is adapted for use with cooking equipment of any type, and especially restaurant cooking equipment, which requires an exhaust hood for exhausting smoke, grease, odors and other pollutants from a building, and to replace the air so exhausted from the building in which the cooking equipment is used.

We claim:

1. An air ventilation system for cooking equipment having an exhaust hood disposed thereover in a kitchen in a building having a heating-ventilating and air-conditioning means for temperature treating the air in the building, characterized in that:

(a) the exhaust hood is provided with a collection chamber disposed upwardly from and over the cooking equipment;

(b) an exhaust chamber is formed in said exhaust hood and communicates with said collection chamber through an opening therebetween;

(c) filter means is operatively mounted in said opening between said collection chamber and said exhaust chamber;

(d) an exhaust passage means is connected to said exhaust chamber and extends from the kitchen to the exterior of the building in which the exhaust hood is mounted;

(e) an exhaust fan means is operatively mounted on the exterior end of said exhaust passage means for exhausting a predetermined volume of air from said collection chamber and through the filter means, to exhaust cooking vapors, odors, fumes, smoke and other pollutants from the collection chamber;

(f) a first and second source of fresh air is provided;

(g) a first fresh air passage means is connected to said first source of fresh air and an air intake chamber in said exhaust hood;

(h) said air intake chamber communicates with said collection chamber through an opening in which is disposed a fresh air diffuser means for directing fresh air from the first fresh air passage means toward the filter means;

(i) a temperature control unit is operatively mounted in said building and is connected by an air curtain passage means, including a vertical portion disposed adjacent and along the front of the exhaust hood, for directing a temperature controlled air curtain downwardly along the front side of the exhaust hood, to prevent cooking vapors, odors, fumes, smoke and other pollutants arising from the cooking equipment to flow into the building from the kitchen in which the cooking equipment is positioned;

(j) a second fresh air passage means is operatively connected between said second source of fresh air and said temperature control unit for selectively supplying fresh air to said temperature control unit;

(k) a temperature treated air passage means is provided for selectively supplying temperature treated air to the temperature control unit from a source of the same which is exterior to the kitchen in which the cooking equipment is positioned; and, (l) said second fresh air passage means and temperature treated air passage means each includes flow control means for selectively controlling the flow of any combination volume of fresh air and temperature treated air to the temperature control unit, for forming an air curtain of a predetermined temperature.

2. An air ventilation system for cooking equipment having an exhaust hood as defined in claim 1, characterized in that:

(a) said air curtain passage means includes an angled diffuser means at an exit end thereof along the front side of the exhaust hood for directing the air curtain inwardly under the exhaust hood.

3. An air ventilation system for cooking equipment having an exhaust hood as defined in claim 2, characterized in that:

(a) said diffuser means in said air curtain passage means is removably mounted in the air curtain passage means.

4. An air ventilation system for cooking equipment having an exhaust hood as defined in claim 1, characterized in that:

(a) said flow control means for selectively controlling the flow of any combination volume of fresh air and temperature treated air to the temperature control unit includes, a first adjustable damper means mounted in said second fresh air passage means to control the flow of fresh air into the temperature control unit, and a second adjustable damper means mounted in said temperature treated air passage means to control the flow of temperature treated air into the temperature control unit.

5. An air ventilation system for cooking equipment having an exhaust hood as defined in either one of claims 1 or 4, characterized in that:

(a) said temperature treated air passage means is connected to a return air duct passage means of the heating-ventilating and air-conditioning means for the building.

6. An air ventilation system for cooking equipment having an exhaust hood as defined in either one of claims 1 or 4, characterized in that:

(a) said temperature treated passage means is connected to a room in the building.

7. An air ventilation system for cooking equipment having an exhaust hood as defined in claim 1, characterized in that:

(a) said filter means is removably mounted in said opening between said collection chamber and said exhaust chamber.

8. An air ventilation system for cooking equipment having an exhaust hood as defined in claim 7, characterized in that:

(a) the intake chamber is constructed and arranged so as to provide a low velocity flow of fresh air from the intake chamber and through the fresh air diffuser means in the opening between the intake chamber and the collection chamber and across the collection chamber into engagement with said filter means.

9. An air ventilation system for cooking equipment having an exhaust hood as defined in claim 1, characterized in that:

(a) said fresh air diffuser means is removably mounted in said opening between said intake chamber and said collection chamber and has diffuser blades disposed at an angle to direct the flow of fresh air across the collection chamber so as to engage the filter means between the collection chamber and the exhaust chamber in a directional flow about perpendicular to the filter means.

10. An air ventilation system for cooking equipment having an exhaust hood as defined in claim 1, characterized in that:

(a) said filter means is detachably mounted between an upper bracket, and a lower bracket which forms a grease gutter to collect grease flowing downwardly from the filter means.

11. An air ventilation system for cooling equipment having an exhaust hood as defined in claim 10, characterized in that:

(a) a removable grease receptacle is detachably mounted below said grease gutter to collect grease draining from the grease gutter through at least one drain hole in the grease gutter.

12. An air ventilation system for cooking equipment having an exhaust hood as defined in claim 10, characterized in that:

(a) said exhaust hood includes an elongated compartment below said grease gutter for the mounting of accessories, as fire extinguisher plumbing and the like, and a removable cover plate for enclosing said compartment.

13. An air ventilation system, for cooking equipment having an exhaust hood disposed thereover and mounted in a building, the exhaust hood being provided with a collection chamber disposed upwardly from and over the cooking equipment, an exhaust chamber formed in said exhaust hood and communicating with said collection chamber through an opening therebetween, an exhaust passage means connected to said exhaust chamber and extending to the exterior of the building, and an exhaust fan means operatively mounted on the exterior end of said exhaust passage means for exhausting a predetermined volume of air from said collection chamber, characterized in that:

(a) a filter means is detachably mounted in said opening between said collection chamber and said exhaust chamber;

(b) said filter means is detachably mounted between an upper bracket, and a lower bracket which forms a grease gutter to collect grease flowing downwardly from the filter means; and (c) said exhaust hood includes an elongated compartment below said grease gutter for the mounting of accessories, as fire extinguisher plumbing and the like, and a removable cover plate for enclosing said compartment.

14. An air ventilation system for cooking equipment having an exhaust hood as defined in claim 13, characterized in that:

(a) a removable grease receptacle is detachably mounted below said grease gutter to collect grease draining from the grease gutter through at least one drain hole in said grease gutter.

* * * * *